US011013662B2

(12) United States Patent
Brandenburger et al.

(10) Patent No.: US 11,013,662 B2
(45) Date of Patent: May 25, 2021

(54) CONNECTOR SYSTEM COMPRISING AT LEAST TWO WITHDRAWAL PORTS

(71) Applicant: Fresenius Kabi Deutschland GmbH, Bad Homburg (DE)

(72) Inventors: Torsten Brandenburger, Reichelsheim (DE); Ismael Rahimy, Friedberg (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 572 days.

(21) Appl. No.: 15/537,055

(22) PCT Filed: Dec. 18, 2015

(86) PCT No.: PCT/EP2015/080601
§ 371 (c)(1),
(2) Date: Jun. 16, 2017

(87) PCT Pub. No.: WO2016/097346
PCT Pub. Date: Jun. 23, 2016

(65) Prior Publication Data

US 2018/0049947 A1 Feb. 22, 2018

(30) Foreign Application Priority Data

Dec. 19, 2014 (EP) ..... 14199473

(51) Int. Cl.
*A61J 1/14* (2006.01)
*A61J 1/10* (2006.01)
*A61J 1/20* (2006.01)

(52) U.S. Cl.
CPC ..... *A61J 1/1481* (2015.05); *A61J 1/10* (2013.01); *A61J 1/1406* (2013.01); *A61J 1/1412* (2013.01); *A61J 1/1487* (2015.05); *A61J 1/201* (2015.05); *A61J 2205/50* (2013.01)

(58) Field of Classification Search
CPC ..... A61J 1/1481; A61J 1/1406; A61J 1/1412; A61J 1/1418; A61J 1/1425; A61J 1/1431; A61J 1/201; A61J 1/10; A61J 2205/50; A61M 39/20
See application file for complete search history.

(56) References Cited

U.S. PATENT DOCUMENTS 5,848,994 A 12/1998 Richmond
6,394,993 B1 5/2002 Chang et al.
8,585,674 B2 * 11/2013 Brandenburger ..... A61J 1/1406 604/403

(Continued)

FOREIGN PATENT DOCUMENTS

CN 102985048 A 3/2013
DE 9110460 10/1991
DE G9110460.2 10/1991

(Continued)

*Primary Examiner* — Philip R Wiest
(74) *Attorney, Agent, or Firm* — Occhiuti & Rohlicek LLP

(57) ABSTRACT

A connector system for connecting a withdrawal device to a container for a medical fluid, in particular for a rinsing solution, comprising a first withdrawal port and a second withdrawal port which are each designed for a withdrawal of the medical fluid from the container, wherein the first withdrawal port and the second withdrawal port are designed differently and each is sealed by a resealable membrane and a break-away cap.

23 Claims, 6 Drawing Sheets

(56) References Cited

U.S. PATENT DOCUMENTS

| | | | | |
|---|---|---|---|---|
| 2008/0009783 | A1* | 1/2008 | Branderburger ..... | A61M 39/20<br>604/30 |
| 2009/0216213 | A1* | 8/2009 | Muir ..... | B65D 1/09<br>604/414 |

FOREIGN PATENT DOCUMENTS

| | | |
|---|---|---|
| DE | 10313760 | 6/2004 |
| EP | 0534136 | 3/1993 |

* cited by examiner

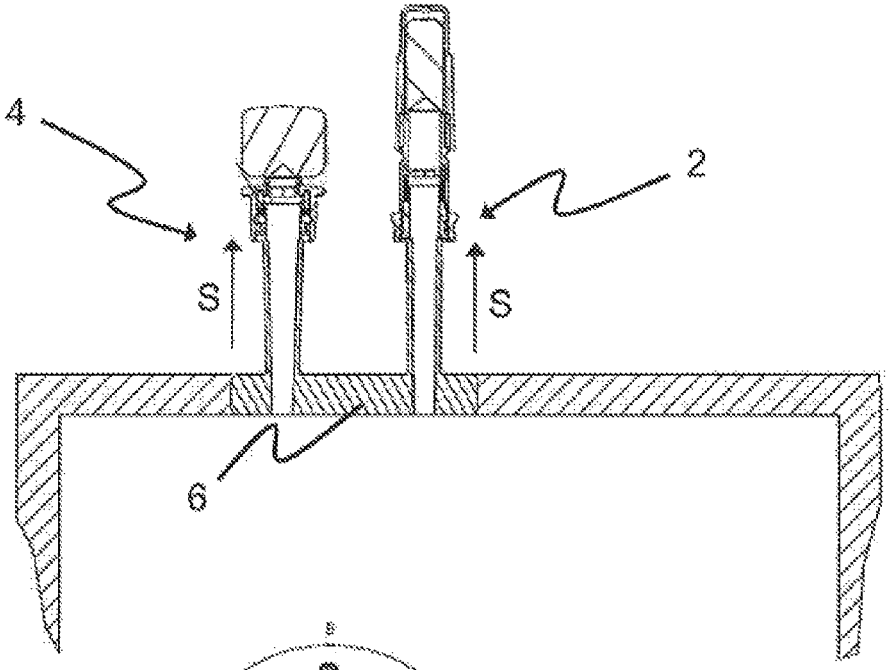
FIG 3.a
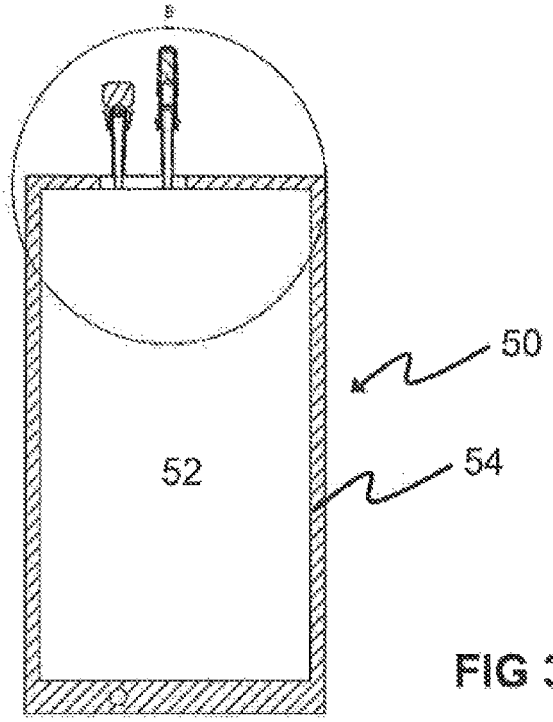
FIG 3.b

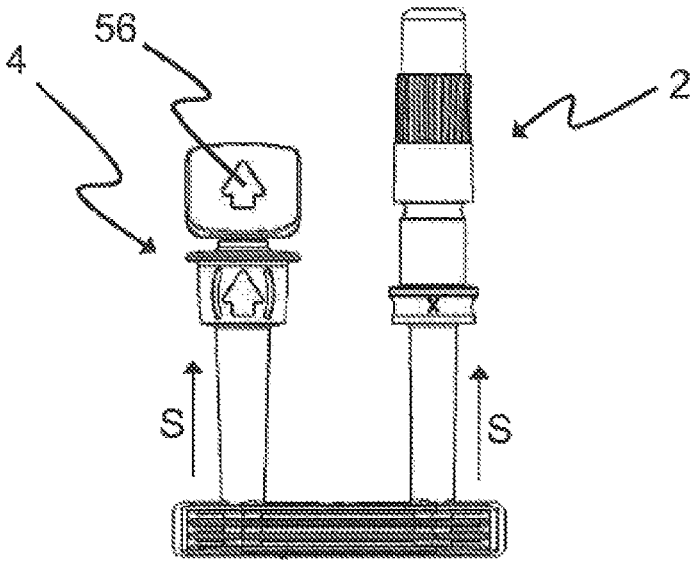
FIG 4.a
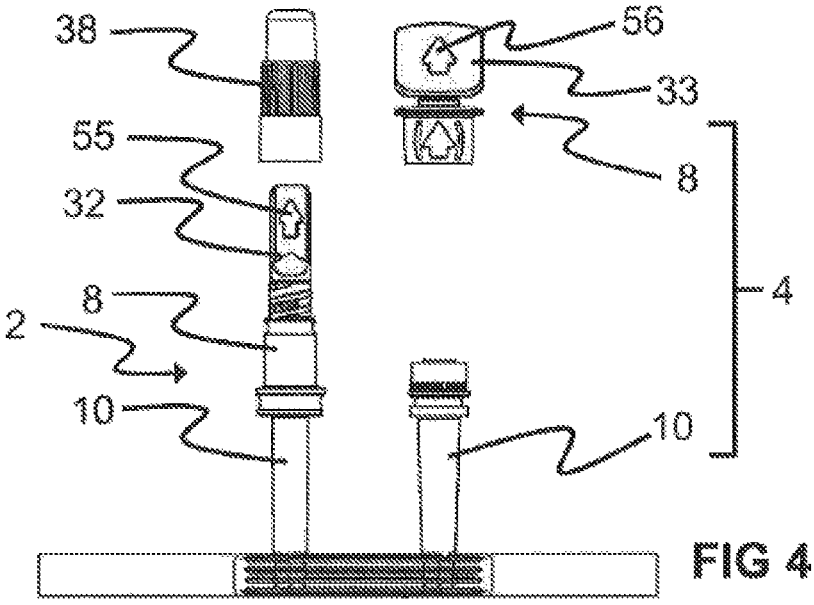
FIG 4.b

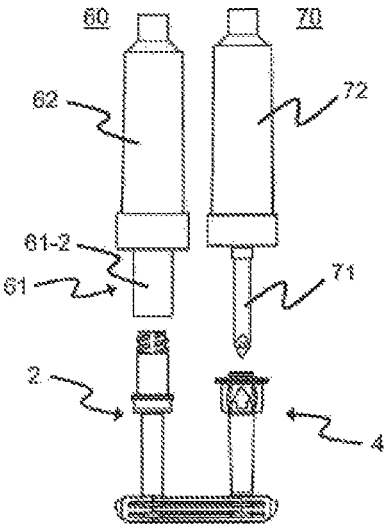
FIG 5.a
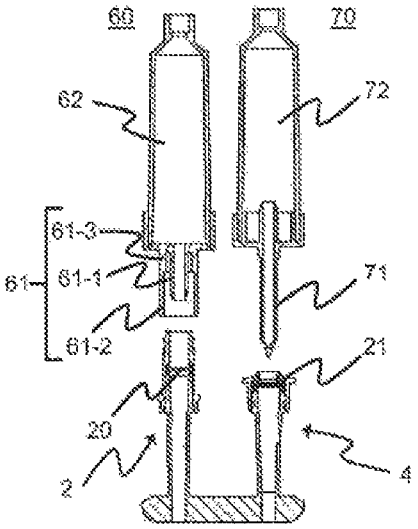
FIG 5.b

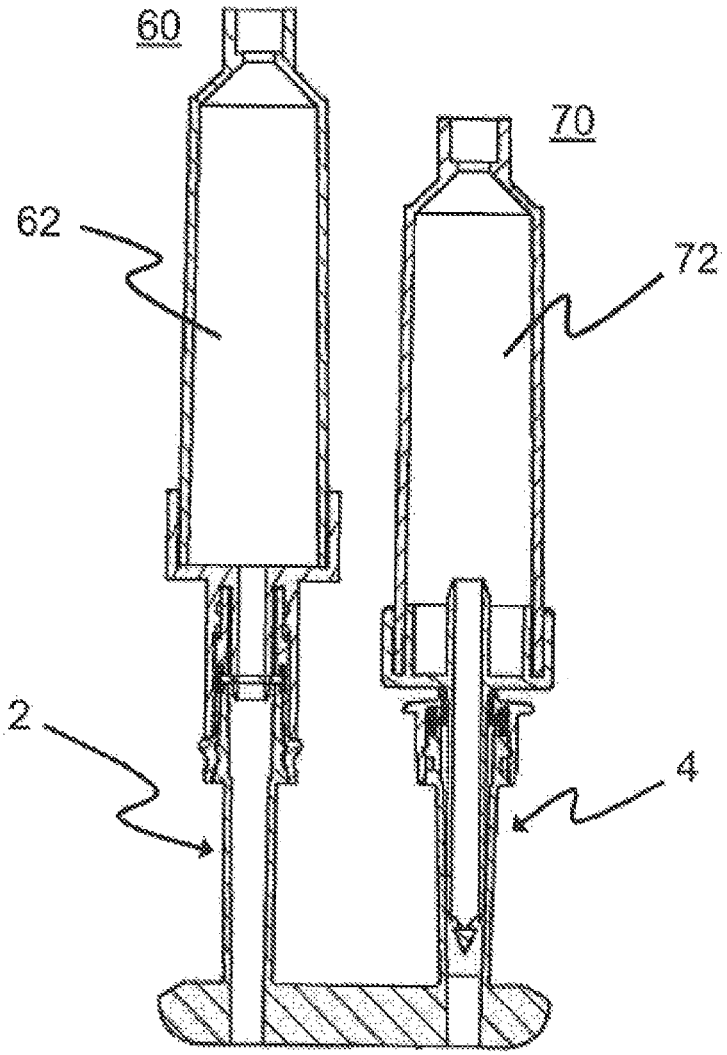
FIG 5.c

CONNECTOR SYSTEM COMPRISING AT LEAST TWO WITHDRAWAL PORTS

CROSS REFERENCE TO RELATED APPLICATIONS

This application is a National Stage of International Application No. PCT/EP2015/080601 filed on Dec. 18, 2015, which claims priority to European Application No. 14199473.1 filed on Dec. 19, 2014, the contents of which are hereby incorporated by reference in their entirety.

The invention relates to a connector system for attaching a withdrawal device to a container for a medical liquid according to the preamble of claim 1, and also to a container for a medical liquid, with such a connector system, according to the preamble of claim 14.

EP 0 534 136 B1 discloses a film bag which is filled with a medical solution and has a connector for withdrawal purposes and a filling nozzle. The contents of the European patent mentioned are fully incorporated into the present patent application by reference.

However, the configuration of the connector for withdrawal purposes restricts the choice of an appropriate withdrawal device. In particular in the case of rinsing solutions which are used in different medical areas, this may be disadvantageous since the same withdrawal devices are not customary or available in all areas.

The invention is based on the problem of specifying a connector system of the type mentioned at the beginning and also a container for a medical liquid, which are versatile.

This problem is solved in respect of the connector system by the features of claim 1. It is a connector system for attaching a or at least one withdrawal device, preferably two withdrawal devices, to a container for a medical liquid, in particular for a medical rinsing solution. The connector system comprises a first withdrawal port and a second withdrawal port, which are each designed for withdrawing the medical liquid from the container: the first withdrawal port and the second withdrawal port are each closed by a reclosable membrane and a break-off cap as a tamper-evident closure. In addition, the first withdrawal port and the second withdrawal port are of different designs. This has the advantage that the user no longer needs to modify the withdrawal port in order to be able to use it with the withdrawal devices available to him. It is also no longer necessary to keep rinsing solution containers with different withdrawal ports ready. In addition, the ports can be provided in a sterile state.

When used as intended, a connector system of the above-mentioned type closes off an in particular sterile container containing a medical liquid and permits the production of a fluid connection between the container containing the medical liquid and a withdrawal device. To produce the fluid connection, that is to say to be able to withdraw medical liquid from the container, according to the invention the first withdrawal port and the second withdrawal port are provided. The connector system can be suitable as a medical connector system, in particular for the sterile connection of an infusion or dialysis bag or of a rinsing solution bag as containers, on the one hand, and of a transfer device or other medical assemblies as withdrawal device, on the other hand.

In particular, the first withdrawal port and the second withdrawal port can be of different designs such that they can receive a withdrawal device with in each case different flow rates and/or different attachments. The first withdrawal port and/or the first withdrawal device are preferably designed in such a manner that a greater flow rate in comparison to the second withdrawal port and/or the second withdrawal device can be provided. The first withdrawal device and the second withdrawal device can also be attached at the same time to the container.

In an embodiment, the first withdrawal port is designed to receive a first withdrawal device with a cylinder attachment, and/or the second withdrawal port is designed to receive a second withdrawal device with a spike attachment. The first and/or the second withdrawal device can comprise a drip chamber and/or a flexible tube of a transfer system. The cylinder attachment of the first withdrawal device can also be referred to as a tubular attachment. The cylinder attachment system is preferably provided with a thread in order to prevent an unintentional release from the connector system.

The cylinder attachment comprises at least one substantially cylindrical tubular portion which can be inserted into the first withdrawal port. At the latest when fully inserted, the cylinder attachment opens the membrane. The cylinder attachment preferably does not have a point, for example in contrast to a spike attachment. The end surfaces of the cylinder attachment, which press against the membrane, are arranged substantially transversely, preferably perpendicularly, with respect to the longitudinal axis of the cylinder attachment. The end surfaces can have a cut in order to assist the opening of the membrane. In a further refinement, the front portion of the cylinder attachment, in particular additionally, can be conical at least in part. However, the cylinder attachment as such does not have any oblique cut. The cylinder attachment is preferably an attachment of the care-lock type.

In a refinement, the first withdrawal port has an outer thread. By means of the cylinder attachment of the first withdrawal device being screwed on, said cylinder attachment can be connected to the first withdrawal port and a fluid connection can be produced by opening the membrane. In a further refinement, the second withdrawal port can be connected to the second withdrawal device by means of the spike attachment of the second withdrawal device being pushed into the membrane of the second withdrawal port, and a fluid connection can be produced by opening the membrane.

The first withdrawal port and the second withdrawal port of the connector system customarily each have a channel for producing a fluid connection between the container and the withdrawal device. The channel of the second withdrawal port can have in part a larger internal diameter than the channel of the first withdrawal port, in order to be able to provide a different flow rate in relation to the first withdrawal port. In addition, the channel of the first withdrawal port can be longer than the channel of the second withdrawal port. In an embodiment, the channel of the second withdrawal port has a cross section tapering in the direction of the container. The channel of the second withdrawal port is preferably of such a length that the insert spike of the second withdrawal device, in the fully inserted state, extends at least half way along the channel. The second withdrawal device can thereby be held securely in the second withdrawal port.

In a further refinement, a preferably transparent protective cap is arranged on the first withdrawal port. The protective cap preferably has an inner thread and is fastened onto the outer thread of the first withdrawal port in a releasable manner, in particular is screwed on or can be screwed on in the pristine state. As a result, the break-off cap is effectively protected against unintentional breaking off, dust and contamination. If the protective cap is formed transparently, the pristine state of said port can be checked visually through the protective cap.

In order in particular to simplify the opening of the connector system, the break-off caps of the first and/or of the second withdrawal port are each designed as flat grips, in one variant. Said caps can also merely include the flat grips. In an embodiment, the break-off caps are fitted in this manner without touching the piercing points. The break-off caps of the first and second withdrawal port preferably each have an arrow, said arrows identifying the first and second withdrawal port as withdrawal port for withdrawing a liquid.

In a refinement, the break-off cap of the first withdrawal port is higher than the break-off cap of the second withdrawal port, and/or the break-off cap of the second withdrawal port is broader than the break-off cap of the first withdrawal port. The two withdrawal ports can thereby be simply differentiated by the user. In addition, in particular the breaking off of the cap of the first withdrawal port is simplified since said cap projects upward.

The first withdrawal port and the second withdrawal port each have a membrane which is also referred to below as sealing element. The latter extends over the entire cross section of the respective channel in order to seal off the container. In an embodiment of the connector system, the first withdrawal port and the second withdrawal port each have a lower part and an upper part sitting on the lower part, wherein the upper part and the lower part are designed as connection pieces fitted on each other with snap-fit engagement, as a result of which the assembly of the connector system can be simplified. In addition, a snap-fit connection can be reproduced. In particular, a formation of particles that possibly occurs, for example, during the ultrasonic welding method can also be avoided or at least reduced by means of the snap-fit connection.

The sealing element can be clamped between the upper part and the lower part. The sealing element is preferably elastic and reclosable. The sealing element of the first withdrawal port can preferably be manufactured from a thermoplastic elastomer. However, it can also be manufactured from polyisoprene, silicone or chlorobuthyl. The sealing element of the second withdrawal port can preferably be manufactured from polyisoprene.

In order to facilitate the insertion of the withdrawal device into the membrane, the sealing element of the first withdrawal port can comprise a preferably continuous slit valve. Alternatively or additionally, the membrane of the second withdrawal port can also comprise a preferably partially punched or continuous slit valve.

In order to avoid mutual twisting of upper part and lower part and therefore possibly damage to the elastic membrane which can be arranged between the upper part and the lower part, an area of the upper part and an area of the lower part can be provided that interact for the rotation lock of the upper part and the lower part.

The sealing element of the second withdrawal port which is configured in particular for lower flow rates can have a central reinforcement area with a material thickness greater than the material thickness of an area immediately surrounding the central reinforcement area. The second withdrawal device with the spike attachment can therefore be held stably by the sealing element itself when the spike attachment of the second withdrawal device penetrates the sealing element. The sealing element of the first withdrawal port is preferably designed, in the area lying in the channel of the first withdrawal port, as a substantially flat disk. As a result, in particular the interaction with the cylinder attachment of the second withdrawal device is made possible.

In order to ensure particularly good retention of the sealing element in the second withdrawal port, a double holding device can be provided on the upper part of the second withdrawal port. In particular, a ring and a projection concentrically surrounding the ring can be formed on the upper part, extend from the upper part in the direction of the lower part and, when the sealing element is arranged as intended, lie against the sealing element in order to avoid slipping of the sealing element in the withdrawal port.

In order to secure the withdrawal device on the first withdrawal port, the first withdrawal port can have an outer thread, for example on the upper part, via which the withdrawal device can be connected to the first withdrawal port in a releasable manner.

The material of the first withdrawal port and/or of the second withdrawal port can be or can comprise polypropylene. The protective cap of the first withdrawal port can likewise be made from polypropylene or can comprise the latter.

In general, it is also conceivable for the connector system to have more than two withdrawal ports which are each of different designs.

The invention also includes a container for a medical liquid, with a connector system according to the invention. The medical liquid is preferably a rinsing liquid. The latter can be used, for example, during diagnosis and/or during operative interventions, for example in urology, cystoscopy and/or arthroscopy. The first withdrawal port is preferably used in arthroscopy. The second withdrawal port is preferably used in urology. The container is preferably a bag which has in particular a capacity of more than 1000 ml.

Furthermore, the invention also includes a system comprising an embodiment of the connector system according to the invention, in particular comprising a bag with a connector system according to the invention fastened to the bag, and a first withdrawal device with a cylinder attachment and/or a second withdrawal device with a spike attachment.

The invention will be described in detail below with reference to exemplary embodiments in conjunction with the drawings.

Figure 1:
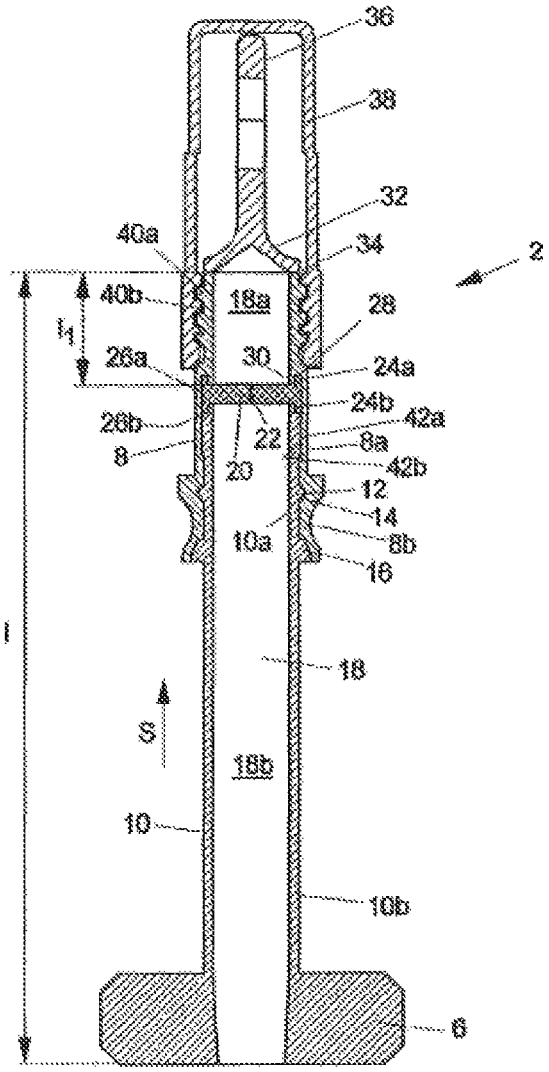
FIG. 1 shows a side view in section of a first withdrawal port of a connector system according to a first embodiment of the invention.
Figure 2:
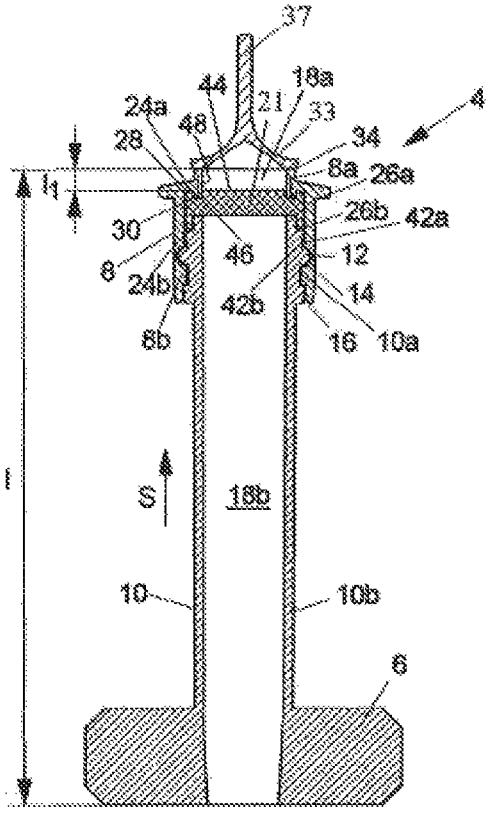
FIG. 2 shows a side view in section of a second withdrawal port of a connector system according to a first embodiment of the invention.

FIG. 3.*a* shows a side view in section of a connector system according to a second embodiment with the withdrawal ports from FIGS. 1 and 2 on a container (zoom B from FIG. 3.*b*);

FIG. 3.*b* shows a side view in section of the entire container for a medical liquid with the connector system from FIG. 3.*a;*

FIG. 4.*a* shows a side view of the connector system from FIGS. 3.*a* and 3.*b;*

FIG. 4.*b* shows the (laterally inverted) illustration from FIG. 4.*a* of the first withdrawal port with removed protective cap and of the second withdrawal port with the upper part not yet fitted;

FIG. 5.*a* shows the connector system from FIG. 4.*b* with removed protective cap and removed or broken-off caps and with a first withdrawal device comprising a cylinder attachment, and a second withdrawal device comprising a spike attachment, in a side view;

FIG. 5.*b* shows the illustration from FIG. 5.*a* in a cross-sectional view; and FIG. 5.*c* shows the illustration from FIG. 5.*b* with the first withdrawal device (with cylinder attachment) inserted into the first withdrawal port, and the second withdrawal device (with spike attachment) inserted into the second withdrawal port.

FIGS. 1 and 2 illustrate a first withdrawal port 2 and a second withdrawal port 4 which together form a connector system. Via the withdrawal ports 2, 4, a medical liquid can be withdrawn from a container (not illustrated here), to which the withdrawal ports 2, 4 can be fastened or are fastened, along a flow direction S. In an exemplary embodiment, the first withdrawal port 2 and the second withdrawal port 4 each comprise a carrier 6 which is designed in the form of a small ship and serves for fastening the withdrawal ports 2, 4 to the container. The small ship 6 comprises, as viewed in the flow direction S, two convexly shaped outer walls which each converge at their ends at an acute angle. The convexly shaped outer walls can have a grooved surface structure, as result of which the strength of the connection of the small ship 6 to the container is increased by enlarging the surface of the outer walls (also see FIGS. 4.*a*, 4.*b* and 5.*a* in this respect). The container is, for example, a bag made from a plastic with one material layer or two, three or more material layers. The small ships 6 can be welded in an edge region between the material layers in order to fasten the first withdrawal port 2 and the second withdrawal port 4 to the container. A first withdrawal device 60 with a cylinder attachment 61 can be attached in a sealing manner to the first withdrawal port 2 (see the left-hand side of FIGS. 5.*a* to 5.*c* in this respect). A second withdrawal device 70 with a spike attachment 71 can be attached in a sealing manner to the second withdrawal port 4 (see the right-hand side of FIGS. 5.*a* to 5.*c* in this respect).

The first withdrawal port 2 comprises an upper part 8 which sits on a lower part 10. The upper part 8 has an upper portion 8*a* facing away from the lower part 10 and a lower portion 8*b* facing the lower part 10. The upper portion 8*a* serves for receiving a withdrawal device 60, for example a flexible tube line, with a cylinder attachment 61. The lower part 10 has an upper portion 10*a* facing the upper part 8 and a lower portion 10*b* facing away from the upper part 8. The lower portion 8*b* of the upper part 8 and the upper portion 10*a* of the lower part 10 are designed here as connection pieces fitted on each other with snap-fit engagement and connecting the upper part 8 and the lower part 10 to each other when arranged as intended. The lower portion 10*b* of the lower part 10 bears the small ship 6 via which the first withdrawal port 2 can be connected to the container.

In order to form a snap-fit connection between the upper part 8 and the lower part 10, the lower part 10 has a projection 12 which extends in a plane transversely with respect to the flow direction S and encircles the lower part 10 in the circumferential direction on the outer side of the lower part 10, and the upper part 8 has a corresponding groove 14, which is provided on the inner side of the upper part 8, for receiving the projection 12. Alternatively, the projection 12 can be formed on the inner side of the upper part 8 and the groove 14 can be formed on the outer side of the lower part 10. In both cases, the upper part 8 engages in part around the lower part 10, and therefore the upper part 8 forms a female connector element and the lower part 10 forms a male connector element. Alternatively, the connection pieces can be designed in such a manner that the lower part 10 engages in part around the upper part 8 (the upper part 8 is therefore a male connector element and the lower part 10 is a female connector element). In this case, a projection or a groove is formed on the outer side of the upper part 8 and a groove or a projection is formed in a complementary manner on the inner side of the lower part 10. Another embodiment would be a connection by means of welding.

In order to avoid the groove 14 moving beyond the projection 12 in the event of a very high application of force during the connection of the upper part 8 to the lower part 10, the lower part 10 has a stop 16 which blocks the movement of the upper part 8 as soon as that end of the upper part 8 which faces the lower part 10 lies against the stop 16 when arranged as intended. This also has the advantage that a sealing element 20 which is described further below and is arranged as intended between the upper part 8 and the lower part 10 cannot be damaged during the assembly of the upper part 8 and the lower part 10.

The upper part 8 and the lower part 10 are each designed as a hollow body with a channel 18*a*, 18*b*. In the connected state, that is to say when the upper part 8 and the lower part 10 are connected to each other, the channel 18*a* of the upper part 8 and the channel 18*b* of the lower part 10 form a channel 18 which extends along the flow direction S.

A sealing element 20 is arranged on the upper portion 10*a* of the lower part 10, which sealing element can be opened, for example can be penetrated, by the cylinder attachment 61 of the second withdrawal device 60 in order to produce a fluid connection between a container, to which the first withdrawal port 2 can be fastened, and the withdrawal device 60. In particular, the sealing element 20 rests on that end of the lower part 10 which faces the upper part 8. The sealing element 20 is designed as an elastic reclosable membrane 20. For example, the membrane 20 is manufactured from a thermoplastic elastomer. However, it can also be manufactured from polyisoprene, silicone or chlorobuthyl. The membrane 20 extends over the entire cross section of the lower part 10, at the end thereof facing the upper part, in order to seal off the first withdrawal port 2 and therefore the container. The membrane 20 comprises a preferably continuous slit valve 22 in order to permit or at least to facilitate the insertion of the cylinder attachment 61 of the withdrawal device 60 and the production of a fluid connection. The membrane 20 is suitable in particular for the use of withdrawal devices of the care-lock type.

In order to permit precise positioning of the membrane 20 on the lower part 10 and therefore to achieve the desired sealing effect of the membrane 20, the membrane has, along its circumferential edge on its side facing the lower part 10, a collar 24*b* projecting counter to the flow direction S. To place said collar 24*b* on the lower part 10, the lower part 10 has a corresponding receiving region 26*b* for the collar 24*b*. The receiving region 26*b* is specifically formed by a reduction in part of the external diameter of the lower part 10, at the end thereof facing the upper part 8.

In addition, the membrane 20 has, along its circumferential edge on its side facing the upper part 8, a collar 24*a* projecting along the flow direction S.

In order to avoid the membrane 20 being displaced axially along the flow direction S in the connected state, the upper part 8 has a receiving region 26*a* for the membrane 20. Above the receiving region 26*a*, i.e. adjacent that end of the receiving region 26*a* which faces away from the lower part 10, the internal diameter of the upper part 8 is smaller than the internal diameter of the receiving region 26*a* of the upper part 8, as a result of which a stop 28 is formed at that end of the receiving region 26*a* which faces away from the lower part 10 and against which the collar 24*a* of the membrane 20 lies when arranged as intended.

For the radial stabilization of the membrane 20, an annular projection 30 projects axially from the stop 28 in the direction of the lower part 10 into the receiving region 26*a*, wherein the projection 30 is arranged at a distance from the circumferential wall of the upper part 8, said circumferential wall bounding the receiving region 26*a*. When connected as intended, the collar 24*a* is arranged radially between the projection 30 and the circumferential wall. The annular projection 30 and the collar 24*a* are dimensioned here in such a manner that the collar 24*a* lies against the projection 30 and against the circumferential wall of the upper part 8, said circumferential wall bounding the receiving region 26*a*.

In the connected state, the membrane 20 is held radially by being placed in the receiving regions 26*a*, 26*b*, and therefore, for example when a cylinder attachment is inserted into or against the membrane 20, slipping of the membrane is avoided.

The upper part 8 is closed at its end facing away from the lower part 10 with a break-off cap 32 in order to protect the membrane 20. Furthermore, the break-off cap serves as a tamper-evident closure. In order to facilitate the breaking off of the cap 32, an encircling predetermined breaking point 34 is formed between the cap 32 and that end of the upper part 8 which faces away from the lower part 10. Furthermore, a grip 36 is provided on the cap 32 in order to be able to grip the cap 32 to break the latter off.

In order to prevent the break-off cap 32 from breaking off accidentally, for example during transport of the first withdrawal port 2, the break-off cap 32 is surrounded by a protective cap 38 which is fastened to the upper portion 8*a* of the upper part 8 via a screw connection. In order to produce the screw connection, a thread 40*a* is provided on the outer side of the upper portion 8*a* of the upper part 8 and a thread 40*b* is provided on the inner side of the protective cap 38. The thread 40*a* of the upper part 8 furthermore serves to additionally fasten a withdrawal device 60, which comprises a union nut with an internal thread 61-3, to the upper part 8 in order to prevent inadvertent slipping of the withdrawal device 60 out of the membrane 20 (see FIGS. 5.*a* to 5.*c* in this regard).

In order to prevent the upper part 8 from rotating with respect to the lower part 10, for example during breaking off or twisting off of the tamper-evident cap 32 or when unscrewing the protective cap 38 or when the withdrawal device 60 is connected, a rotation lock is provided. The rotation lock is formed by elements which are different from the elements for producing the snap-fit connection between the upper part 8 and the lower part 10. For the rotation lock, a tooth profile 42*a* is formed along the circumferential direction on the inner side of the upper part 8 and a tooth profile 42*b* is formed on the outer side of the lower part 10, wherein the teeth of the tooth profiles 42*a*, 42*b* extend axially along the flow direction S. In the exemplary embodiment illustrated in FIG. 1, the tooth profile 42*b* of the lower part 10 is arranged below the receiving region 26*b* for the collar 24*b* of the membrane 20. For the rotation lock, the teeth of the two tooth profiles 42*a*, 42*b* intermesh. Accordingly, the tooth profile 42*a* of the upper part 8 is provided at a height which corresponds to the height of the tooth profile 42*b* of the lower part 10 in the connected state. Alternatively, other means are conceivable for the rotation lock, such as, for example, a pin and a corresponding receptacle or an axial web or a plurality of axial webs on the lower part 10 and accordingly a groove or a plurality of grooves in the upper part 8, said means extending along the flow direction S.

The channel 18 has a length l of 5 to 8 cm, preferably of 6 to 7 cm, in particular preferably of 6.5 cm. The stated length l corresponds to the length after removal of the break-off cap 32. The portion of the upper part 8 that lies between that end of the upper part 8 which faces away from the lower part 10 (after removal of the break-off cap 32) and the receiving region 26*a* has a length $l_1$ of 0.8 to 1.6 cm, preferably of 1.0 to 1.4 cm, particularly preferably of 1.2 cm. Said portion substantially corresponds to the upper portion 8*a* of the upper part 8, which serves for receiving a withdrawal device.

The channel 18*b* of the lower part 10 is of slightly conical design, and therefore the internal diameter of the channel 18*b* of the lower part 10 varies over the length of the channel 18*b*. Thus, the internal diameter of the channel 18*b* at its end facing the upper part 8 is 5 to 8 mm, preferably 6 to 7 mm, in particular preferably 6.5 mm. The internal diameter of the channel 18*b* at its end facing away from the upper part 8 is 2 to 6 mm, preferably 3 to 5 mm, in particular preferably 4 mm. Furthermore, the internal diameter of the channel 18*a* of the upper part 8 at its end facing away from the lower part 10 is 4 to 8 mm, preferably 5 to 7 mm, in particular preferably 6 mm.

The second withdrawal port 4 (FIG. 2) is similar in its design to the first withdrawal port 2. The same reference signs are therefore used for the same elements in the figures. The description of the second withdrawal port 4 discusses in particular the differences in relation to the first withdrawal port 2. It goes without saying that the description of the first withdrawal port 2 also applies to the second withdrawal port 4, with the exception of the differences explained below.

The second withdrawal port 4 differs from the first withdrawal port 2 by the fact that a second withdrawal device 70 with a spike attachment 71 can be attached.

It therefore differs in particular also in terms of its dimensions. The channel 18 of the second withdrawal port 4 has a length 3 of 3.5 to 6.5 cm, preferably of 4.5 to 5.5 cm, in particular preferably of 5 cm. The stated length l corresponds to the length after removal of the break-off cap 33. The break-off cap 33 of the second withdrawal port 4 has a greater breadth and a smaller height here than the break-off cap 32 of the first withdrawal port 2. The break-off cap 33 here comprises a flat grip 37. The portion of the upper part 8 which lies between that end of the upper part 8 which faces away from the lower part 10 (after removal of the break-off cap 33) and the receiving region 26*a* has a length $l_1$ of 2 to 5 mm, preferably of 3 to 4 mm. This portion substantially corresponds to the upper portion 8*a* of the upper part 8, which serves for receiving a withdrawal device.

The channel 18*b* of the lower part 10 is of slightly conical design, and therefore the internal diameter of the channel 18*b* varies over the length of the lower part 10. Thus, the internal diameter of the channel 18*b* at the end 5 facing the upper part 8 is 5 to 9 mm, preferably 6 to 8 mm, in particular preferably 7 mm. The internal diameter of the channel 18*b* at the end facing away from the upper part 8 is 2 to 6 mm, preferably 3 to 5 mm, in particular preferably 4 mm. Furthermore, the internal diameter of the channel 18*a* of the upper part 8 at the end facing away from the lower part 10 is 4 to 8 mm, preferably 5 to 7 mm, in particular preferably 6 mm.

In contrast to the first withdrawal port 2, the membrane 21 of the second withdrawal port 4 is manufactured from polyisoprene. A slit valve is preferably not formed in the membrane 21 of the second withdrawal port 4. Said membrane 21 can be pierced by the pointed spike attachment and therefore opened. However, in order to simplify the opening, a preferably continuous or partially punched slit valve can also be formed here.

In addition to the collar 24*a* facing the upper part 8 and the collar 24*b* facing the lower part 10, the membrane 21 of the second withdrawal port 4 has a central reinforcement area 44 which, when arranged as intended, is provided on that side of the membrane 21 which faces the upper part 8. The central reinforcement area 44 is located in an area bounded by the collar 24*a*, wherein the collar 24*a* is spaced apart from the central reinforcement area 44 by an annular gap 46. The central reinforcement area 44 has a height (material thickness along the flow direction S starting from that side of the membrane 21 which faces the upper part 8) which substantially corresponds to the height of the collar 24*a*. Since the portion of the upper part 8 which lies between that end of the upper part 8 which faces away from the lower part 10 (after removal of the break-off cap 33) and the receiving region 26*a* is relatively short, the membrane 21 which is reinforced by the central reinforcement area 44 can assist the retention of the spike attachment 71, which is also referred to as an insert spike, which sticks into the membrane 21. By means of this configuration, reclosing of the membrane 21 after removal of the spike attachment 71 can also be assisted.

In order to retain the membrane 21, a receiving region 26*a* is provided in the upper part 8 and a receiving region 26*b* is provided in the lower part 10, as in the first withdrawal port 2. However, in the case of the second withdrawal port 4, in addition to the projection 30, a ring 48 extending concentrically with respect to the projection 30 projects into the receiving region 26*a*. The ring 48 extends from that end of the upper part 8 which faces away from the lower part 10 within an area bounded by the projection 30 and ends substantially at the same height as that end of the projection 30 which faces the lower part 10. The ring 48 is secured at an axial end at that end of the upper part 8 which faces away from the lower part 10 and is therefore designed to be resilient in the radial direction. Both the projection 30 and the ring 48 lie in the annular gap 46 of the membrane 20 on that side of the membrane 20 which faces the upper part 8 when the membrane 21 is arranged as intended. Furthermore, the second withdrawal port 4 does not have an additional protective cap to protect the break-off cap 33.

FIG. 3.*a* illustrates a further embodiment of the connector system, in which the first withdrawal port 2 from FIG. 1 and the second withdrawal port 4 from FIG. 2 are formed on a common small ship 6. The connector system can be welded or is welded to a container via the small ship 6 in order to seal the container. In FIG. 3.*b*, such a container 50 is illustrated in the form of a film bag with the connector system from FIG. 3.*a*. The film bag 50 is formed, for example, from a plurality of material layers 52 which are connected to one another at their edges via an encircling weld seam 54. The connector system, in particular the small ship 6 of the connector system, is arranged in the region of the weld seam 54 between the material layers 52 and is welded in a sealing manner to the two material layers 52. The weld seam 54 in the connector system therefore tightly close off from the surroundings an interior space of the container, in which, for example, a medical liquid is stored. To withdraw the medical liquid from the container 50, a withdrawal device 60 or 70 can be inserted into one of the two withdrawal ports 2, 4. To withdraw the medical liquid from the container 50, the first and the second withdrawal device 60 and 70 can also be inserted at the same time or together into the respective withdrawal port 2, 4.

FIG. 4.*a* shows a side view of the connector system from FIGS. 3.*a* and 3.*b*. FIG. 4.*b* shows the (laterally inverted) illustration from FIG. 4.*a*. In contrast to FIG. 4.*a*, the protective cap 38 has already been removed from the first withdrawal port 2.

In addition, at the second withdrawal port 4, the upper part 8 is not yet fitted on the lower part 10. The arrows 55, 56 on or in the break-off caps 32 and 33, which arrows identify the two withdrawal ports 2 and 4 as withdrawal ports, can clearly be seen. The two arrows are introduced here by way of example as openings in the two caps 32 and 33.

FIGS. 5.*a* to 5.*c* illustrate the interaction of the connector system according to the invention with the withdrawal devices 60 and 70. The break-off caps 32 and have already been removed. The two withdrawal devices here are the first withdrawal device 60 with a cylinder attachment 61 and the second withdrawal device 70 with a spike attachment 71. FIGS. 5.*a* and 5.*b* show the two withdrawal devices 60 and 70 in the non-attached state. By contrast, FIG. 5.*c* shows the two withdrawal devices 60 and 70 in the state connected as intended, here the completely attached state.

FIG. 5.*a* shows the illustration from FIG. 4.*b* with the first withdrawal device 60 and the second withdrawal device 70. The first withdrawal device 60 is assigned to the first withdrawal port 2. The second withdrawal device 70 is assigned to the second withdrawal port 4. The first withdrawal device 60 here comprises an optional drip chamber 62 and a flexible tube (not illustrated here). In addition, it comprises a cylinder attachment 61 for attaching to the first withdrawal port 2. The second withdrawal device 70 here likewise comprises an optional drip chamber 72 and a flexible tube (not illustrated here). However, it now comprises here a spike attachment 71 for attaching to the second withdrawal port 4. For the attachment, the break-off caps 32 and 33 have already been removed from the two ports 2 and 4.

The spike attachment 71 of the second withdrawal device 70 can also be referred to as insert spike or spike. Said spike attachment is inserted into the second withdrawal port 4, uses its point to pierce the membrane 21 and thereby produces a fluid connection. In the inserted state, the spike attachment 71 is held in its position in particular by means of clamping by the membrane 21 and/or the channel 18 and/or by the channel portion above the membrane. The channel 18 of the second withdrawal port 4 is of such a length here that the insert spike 71, in the fully inserted state, extends at least half way along the channel 18. The second withdrawal device 70 can thereby be held securely in the second withdrawal port 4.

The cylinder attachment 61 comprises the inner, substantially cylindrical tubular portion 61-1 which can be inserted into the first withdrawal port 2. The tubular portion 61-1 opens the membrane 20 at the latest in the fully inserted state. The end surfaces of the tubular portion 61-1, which end surfaces press against the membrane 20, are arranged here substantially perpendicularly to the longitudinal axis of the cylinder attachment 61. As illustrated here, the end surfaces or the front portion of the tubular portion 61-1 can have a cut and/or a cone in order to assist the opening of the membrane 20. The cylinder attachment 61 is preferably an attachment of the care-lock type. The cylinder attachment 61 is formed in particular by two concentric tubular portions 61-1 and 61-2 of different length. In this configuration, the outer tubular portion 61-2 has a larger diameter and extends beyond the inner tubular portion 61-1. The two tubular portions 61-1 and 61-2 are of substantially cylindrical design. On the inner side of the outer tubular portion 61-2, a thread 61-3 is arranged in the lower area which lies in the direction of the drip chamber. The cylinder attachment 61 is connected to the withdrawal port 2 by screwing. During the screwing-in operation, the inner shorter tube 61-1 is moved in the direction of the membrane 20 which initially closes the port 2 in a liquid-tight manner. The cylinder attachment 61, here the inner tube 61-1, opens the membrane 20 at the latest in the fully screwed-on state and produces a fluid connection. At least the front area of the inner tubular portion 61-1 penetrates the membrane 20.

It is apparent to a person skilled in the art that the described embodiments should be understood as being by way of example. The invention is not restricted to them, but rather can be varied in diverse ways without departing from the essence of the invention. Features of individual embodiments and the features mentioned in the general part of the description can each be combined among one another or with one another.

The invention claimed is:

1. An apparatus comprising a connector system for attaching first or second withdrawal devices to a bag and for a medical liquid a ship by which said connector system is welded to said bag, wherein said connector system comprises first and second ports, both of which are formed on said ship, said first and second ports being withdrawal ports that are configured such that, in use, medical liquid flows out of said bag through at least one of said ports, a first membrane that closes said first port, said first membrane being reclosable membrane shaped as a flat disk that is disposed at a selected distance from an opening of said first port, a second membrane that closes the second port, said second membrane being a reclosable membrane that comprises a central reinforcement area that is thicker than an area of the membrane immediately surrounding the central reinforcement area, first and second break-off caps disposed to close off said first and second ports respectively, each of said break-off caps being marked by an arrow to identify said ports as being withdrawal ports, a protective cap arranged on the first port, said protective cap having an inner thread and being screwed securely onto the outer thread of the first port in a releasable manner, wherein the first port is configured to receive a first withdrawal device with a cylinder attachment that comprises concentric inner and outer tubular portions with said outer tubular portion extending beyond said inner tubular portion, and wherein said selected distance from an opening of said first port is such that said outer tubular portion forms a seal with said first withdrawal port before said inner tubular portion penetrates said first membrane.

2. The apparatus of claim 1, wherein said first and second ports are configured to receive withdrawal devices with differing flow rates.

3. The apparatus of claim 1, wherein said second port is configured to receive a spike attachment of said second withdrawal device.

4. The apparatus of claim 1, wherein said first port comprises an outer thread, wherein said first port connects to said first withdrawal device as a result of said outer thread engaging a corresponding inner thread on said first withdrawal device to permit said first withdrawal device to form a connection with said outer tubular portion upon being screwed onto said first withdrawal port prior to said inner tubular portion establishing a fluid connection by opening said first membrane, and wherein said second port connects to said second withdrawal device as a result of a spike attachment thereof having been pushed through said second membrane to establish a fluid connection through said spike attachment.

5. The apparatus of claim 1, wherein said first and second ports comprise corresponding first and second channels, wherein said first channel establishes a fluid connection between said bag and said first withdrawal device, wherein said second channel establishes a fluid connection between said bag and said second withdrawal device, and wherein said second channel has a larger internal diameter than said first channel.

6. The apparatus of claim 1, wherein said first and second ports comprise corresponding first and second channels, wherein said first channel establishes a fluid connection between said bag and said first withdrawal device, wherein said second channel establishes a fluid connection between said bag and said second withdrawal device, and wherein said first channel is longer than said second channel.

7. The apparatus of claim 1, wherein at least one of said first and second break-off caps comprises a flat grip.

8. The apparatus of claim 1, wherein said first break-off cap stands taller than said second break-off cap.

9. The apparatus of claim 1, wherein each of said first and second ports comprises a lower part and an upper part that sits on said lower part and that engages said lower part with a snap fit.

10. The apparatus of claim 1, wherein said second port comprises an upper part and a lower part, wherein said upper part comprises a ring and a projection that concentrically surrounds said ring, wherein said ring and said projection extend from said upper part towards said lower part by equal amounts, wherein said ring and said projection retain a sealing element.

11. The apparatus of claim 1, further comprising said bag.

12. The apparatus of claim 1, further comprising at least one of said first withdrawal device and said second withdrawal device, wherein said first withdrawal devices comprises said cylinder attachment and wherein said second withdrawal device comprises a spike attachment.

13. The apparatus of claim 1, further comprising said bag and at least one of said first withdrawal device and said second withdrawal device, wherein said first withdrawal devices comprises said cylinder attachment and wherein said second withdrawal device comprises a spike attachment.

14. The apparatus of claim 1, wherein said protective cap is transparent.

15. The apparatus of claim 1, wherein each of said first and second ports comprises a lower part and an upper part that sits on said lower part and that engages said lower part with a snap fit and clamps a corresponding one of said first and second membranes therebetween.

16. The connector system of claim 1, wherein said protective cap protects said first break-off cap from being unintentionally broken off and from being exposed to dust and contamination.

17. The apparatus of claim 1, wherein said second break-off cap is broader than said first break-off cap.

18. The apparatus of claim 1, wherein said first and second ports comprise corresponding first and second channels, wherein said first channel establishes a fluid connection between said bag and said first withdrawal device, wherein said second channel establishes a fluid connection between said bag and said second withdrawal device, and wherein said second channel has a cross section that tapers in the direction of said bag.

19. The apparatus of claim 1, wherein said first and second ports comprise corresponding first and second channels and wherein said second channel has a length such that a spike inserted fully into said second port extends at least halfway along said second channel.

20. The apparatus of claim 1, wherein said first and second ports are configured to receive withdrawal devices with different attachments.

21. An apparatus comprising a ship and a connector system for attaching first and second withdrawal devices to a bag that contains a medical liquid, wherein said connector system comprises a first port, a second port, and a protective cap, wherein said first and second ports that are of different design and are formed on said ship, wherein said ports are withdrawal ports that are configured to permit withdrawal of said medical liquid, wherein each of said ports is closed by a reclosable membrane and a break-off cap, and wherein said protective cap is arranged on said first port, wherein said protective cap comprises an inner thread that is screwed securely onto the outer thread of said first port in a releasable manner, wherein said first port is configured to receive a cylinder attachment of said first withdrawal device, wherein said cylinder attachment comprises concentric inner and outer tubular portions, with said outer tubular portion extending beyond said inner tubular portion, wherein said second port is configured to receive a spike attachment of a second withdrawal device, and wherein said protective cap, when screwed securely onto said outer thread, prevents said first port from engaging said cylinder attachment.

22. The apparatus of claim 21 wherein the first port includes a screw connection.

23. The apparatus of claim 21, further comprising the bag, the first withdrawal device, and the second withdrawal device.

* * * * *